US007040061B2

(12) United States Patent
Rillie et al.

(10) Patent No.: US 7,040,061 B2
(45) Date of Patent: May 9, 2006

(54) TUBULAR SKYLIGHT WITH DOME FLASHING AND PROTECTIVE CORRUGATION

(75) Inventors: David W. Rillie, Cardiff, CA (US); Joseph W. Prenn, San Diego, CA (US); Michael W. Muhlestein, Vista, CA (US); Christian P. Stevens, Oceanside, CA (US)

(73) Assignee: Solatube International, Inc., Vista, CA (US)

( * ) Notice: Subject to any disclaimer, the term of this patent is extended or adjusted under 35 U.S.C. 154(b) by 0 days.

(21) Appl. No.: 10/653,297

(22) Filed: Sep. 2, 2003

(65) Prior Publication Data

US 2005/0044807 A1 Mar. 3, 2005

(51) Int. Cl.
*E04B 7/18* (2006.01)
*E04D 13/03* (2006.01)

(52) U.S. Cl. ..... 52/200; 52/58; 52/746.11; 285/43

(58) Field of Classification Search ..... 52/199–200, 52/22, 72, 58–62, 97, 747.11; 362/150, 147, 362/591; 285/42–44
See application file for complete search history.

(56) References Cited

U.S. PATENT DOCUMENTS

| | | | | |
|---|---|---|---|---|
| 1,544,391 A | | 6/1925 | Budd et al. | 52/547 |
| 1,557,616 A | | 10/1925 | Riley | 52/547 |
| 2,641,204 A | | 6/1953 | Young | 52/546 |
| 3,124,427 A | | 3/1964 | Chomes | 29/183 |
| 3,646,717 A | | 3/1972 | Parker | 52/548 |
| 4,314,433 A | | 2/1982 | Hulcombe | 52/521 |
| 4,339,900 A | | 7/1982 | Freeman | 52/200 |
| 4,480,534 A | * | 11/1984 | Sloan | 454/182 |
| 4,635,409 A | | 1/1987 | Vandemore | 52/60 |
| 4,664,390 A | * | 5/1987 | Houseman | 277/606 |
| 4,682,454 A | | 7/1987 | Simpson et al. | 52/200 |
| 4,730,426 A | | 3/1988 | Weisner et al. | 52/200 |
| 4,733,505 A | | 3/1988 | Van Dame | 52/22 |
| 4,809,468 A | | 3/1989 | Bareiss | 52/22 |
| 4,966,819 A | * | 10/1990 | Schatz et al. | 428/603 |
| 5,010,700 A | | 4/1991 | Blair | 52/199 |
| 5,046,292 A | * | 9/1991 | Sampson et al. | 52/200 |
| 5,053,266 A | * | 10/1991 | Hesketh et al. | 428/192 |
| 5,099,622 A | | 3/1992 | Sutton | 52/200 |
| 5,226,263 A | | 7/1993 | Merrin et al. | 52/58 |
| 5,435,780 A | | 7/1995 | Ayles | 454/199 |
| 5,546,712 A | | 8/1996 | Bixby | 52/200 |
| D382,347 S | | 8/1997 | Grubb | D25/52 |
| 5,655,339 A | | 8/1997 | DeBlock et al. | 52/200 |
| D389,254 S | | 1/1998 | Grubb | D25/199 |
| D390,976 S | | 2/1998 | Weston | D25/199 |
| 5,878,539 A | | 3/1999 | Grubb | 52/200 |

(Continued)

FOREIGN PATENT DOCUMENTS

EP 38222 * 10/1981

(Continued)

*Primary Examiner*—Winnie Yip
(74) *Attorney, Agent, or Firm*—John L. Rogitz

(57) ABSTRACT

In a tubular skylight, a corrugated Aluminum sheet is formed with a hole that is pressed into a curb which is fastened over the turret of a roof-mounted skylight flashing. Roof tiles above the dome of the skylight are placed onto the sheet, while below the dome the sheet is placed over roof tiles and manually conformed thereto, owing to the corrugations. Any water that leaks past tiles above the dome will be directed by the sheet around the curb and down onto the tops of tiles that are below the dome, thereby providing a water seal for the skylight.

17 Claims, 1 Drawing Sheet

U.S. PATENT DOCUMENTS

| | | | | |
|---|---|---|---|---|
| 5,896,712 | A | 4/1999 | Chao | 52/200 |
| 5,896,713 | A | 4/1999 | Chao et al. | 52/200 |
| RE36,496 | E | 1/2000 | Sutton | 52/200 |
| 6,212,834 | B1 * | 4/2001 | Lindgren | 52/200 |
| 6,263,624 | B1 | 7/2001 | Hoy et al. | 52/200 |
| 6,813,864 | B1 * | 11/2004 | Landis | 52/200 |
| 2003/0150175 | A1 | 8/2003 | Rillie | 52/200 |

FOREIGN PATENT DOCUMENTS

| | | | |
|---|---|---|---|
| JP | 10-37410 | * | 2/1998 |
| JP | 11-306819 | * | 11/1999 |
| WO | WO 94/00654 | * | 1/1994 |
| WO | WO 99/13180 | * | 3/1999 |

* cited by examiner

TUBULAR SKYLIGHT WITH DOME FLASHING AND PROTECTIVE CORRUGATION

FIELD OF THE INVENTION

The present invention relates to skylights.

BACKGROUND OF THE INVENTION

Skylights are used to illuminate buildings in a pleasing and energy-conserving way. Tubular skylights such as those made by the present assignee typically have a roof-mounted transparent cover or dome, a light conveying tube assembly extending down from the dome into the building to a ceiling, and a light diffuser plate covering the bottom of the tube at the ceiling.

To mount the dome on the roof, a flashing typically is provided. The flashing may have a flat skirt that is inclined to match the incline of the roof, and a cylindrical turret extending vertically upward from the skirt. The dome is fastened to the turret, with the tube assembly also engaging the turret to establish a single continuous light passageway through the dome and down into the tube assembly.

Many roofs are tiled. To install a skylight, some of the tiles typically are removed to expose the flat roof substrate, and the skirt of the flashing is then positioned over a hole that is cut into the roof substrate. The tiles are then replaced around the flashing.

The present invention is an improvement to prevent subsequent water leakage from the upper tile surface around the flashing/tile penetration down onto the roof substrate. Previous solutions include placing three or four rectangular pieces of board or other material to fill the gap between the tile penetration and cylindrical turret. While such an arrangement is not without utility, as recognized herein in the context of tubular skylights (and, concomitantly, round flashing turrets), placing several rectangular pieces around a round hole will result in incomplete coverage through which water can flow. Moreover, the present invention recognizes that the previous use of lead pieces, used because of its malleability such that it can be conformed by hand around the tops of the lower tiles, entails structural and health risks. The present invention still further understands that rectangular multi-layer corrugated sealing pieces such as are disclosed in U.S. Pat. No. 6,503,601 not only fail to account for the above-noted geometric mismatch between tubular skylights and rectangular sealing pieces, but also require comparatively elaborate multi-layer construction.

SUMMARY OF THE INVENTION

A tubular skylight includes a transparent dome, a flashing coupled to the dome to mount the dome on a roof, and a skylight tube depending downwardly from the dome. The system also includes a sheet of corrugated metal mounted on the roof and coupled to the flashing. The sheet has a circular hole defining a periphery closely spaced from the flashing. Owing to the corrugations, the sheet is conformable to roof tiles to provide a water seal, as well as a rodent and insect barrier.

In a preferred embodiment, the sheet is formed with a curb circumscribing the hole, and the curb is coupled to the flashing. In one non-limiting implementation, the flashing defines an upper circular edge and bendable tabs extend radially inwardly from the curb of the sheet. The tabs may be bent over the edge to engage the sheet with the flashing without the need for fasteners. The sheet may be made of Aluminum, or it may be made of Copper, Lead, malleable Zinc, plastic, or rubber. Preferably, the corrugations of the sheet extend generally parallel to the incline of the roof when the sheet is mounted on the roof.

In another aspect, a method for mounting a tubular skylight includes receiving a corrugated single piece sheet defining a hole and a curb rising above and circumscribing the hole. The method further includes engaging the curb with a skylight flashing on a roof with an upper portion of the sheet being disposed underneath at least one roof tile above the flashing and with a lower portion of the sheet being disposed on top of at least one roof tile below the flashing. A skylight cover can then be coupled with the flashing.

In still another aspect, a lighting system includes a transparent skylight cover, a light diffuser, and a tubular structure extendable between the cover and diffuser. A single corrugated sheet is configured for circumscribing the tubular structure between the cover and the diffuser to impede water leakage through a roof above which the cover is to be disposed.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
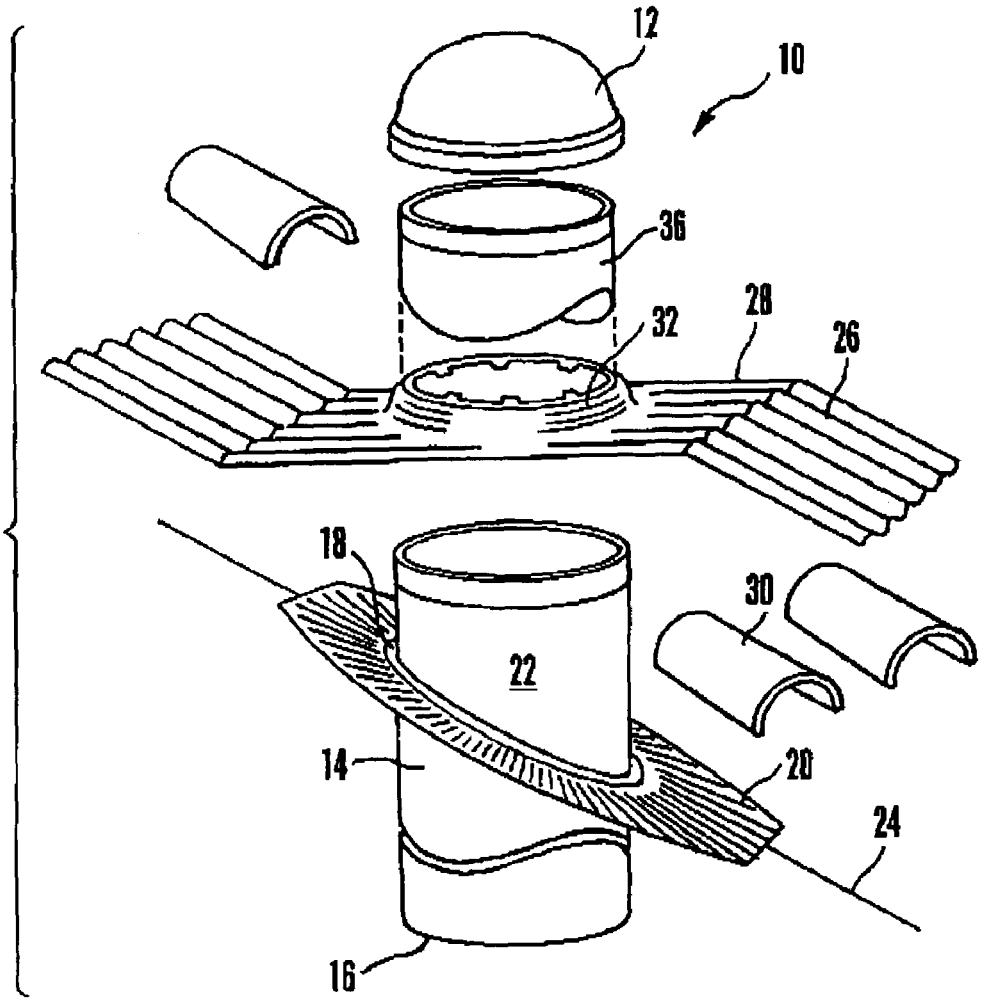
FIG. 1 is a partially exploded perspective view of the present skylight with corrugated sealing member, with portions cut away.

Referring initially to FIG. 1, a skylight is shown, generally designated 10, that includes a roof-mounted hard plastic transparent dome 12, an internally reflective light conveying tube assembly 14 covered by the dome 12, and a ceiling-mounted light diffuser plate 16 covering the bottom end of the tube assembly 14. The preferred skylight 10 is a tubular skylight. A metal flashing 18 having a flat skirt 20 and generally cylindrical turret 22 rising at an incline from the skirt 20 is mounted over a circular hole (not shown) that is cut into a roof 24 of a building by means known in the art to support the dome 12.

A preferably unitary single piece sheet 26 of corrugated metal such as Aluminum is mounted on the roof 24. As shown in FIG. 1, the sheet 26 is coupled to the flashing 18 in accordance with disclosure below. As can be appreciated in cross-reference to FIGS. 1 and 2, the sheet 26 has a circular hole formed in it which defines a periphery 28 that is closely spaced from the turret 22 of the flashing 18. In accordance with present principles, the sheet 26 is conformable to roof tiles 30, and in particular the sheet 26 conforms over the top of roof tiles 30 that are below the turret 22, to provide a seal.

Figure 2:
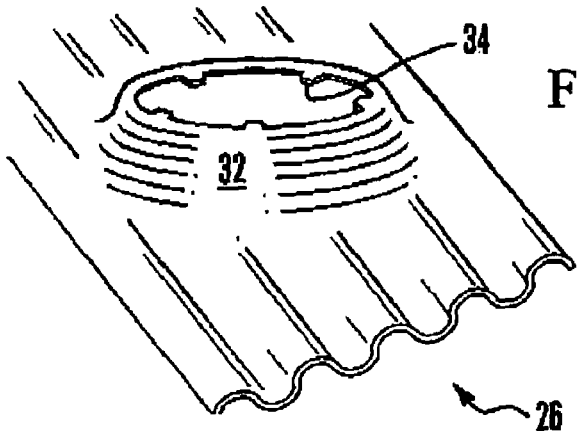
FIG. 2 is a perspective view of the corrugated sealing member.

With more specificity in reference to FIG. 1, the sheet 26 is formed with a cylindrical or frusto-conical shaped curb 32 that circumscribes the hole. To form the curb 32, a hole is cut into the sheet 26 and then the portion of the sheet 26 that is adjacent the hole to pressed into the curb configuration shown. Then, in the preferred embodiment as best shown in FIG. 2, the top of the curb 32 is bent inwardly to a horizontal orientation and then cut to define plural bendable tabs 34 for coupling the sheet 26 to the flashing 18. Specifically, the tabs 34, which extend radially inwardly from the curb 32 of the sheet 26, can be manually bent over the top edge of the flashing 18 to engage the sheet 26 with the flashing 18 without the need for fasteners.

With the above disclosure in mind, and now referring back to FIG. 1, tiles can be removed from the roof 24 and the flashing 18 positioned on the roof with the skirt 20 flat against the roof 24 as shown. Tiles 30 below the flashing 18 can be placed back on the roof 24. Then, the corrugated sheet 26 can be fitted over the turret 22 of the flashing 18, with the curb 32 of the sheet 26 circumscribing the turret 22. The tabs 34 can then be bent over the top edge of the turret 22, and tiles 30 above the flashing 18 replaced over the upper part of the sheet 26 as shown in FIG. 1. Preferably, the elongated corrugations defined by the sheet 26 extend generally parallel to the incline of the roof 24 as shown in FIG. 1 when the sheet 26 is mounted on the roof 24.

Next, if desired a flashing extension 36 can be fastened by, e.g., screws to both the dome 12 and the flashing 18 and/or curb 32 to couple the flashing 18 to the dome 12. The flashing extension 36 can be established by one or more tubes. In any case, owing to the corrugations of the sheet 26, a person can easily deform the sheet 26 as necessary to generally conform to the tiles 30 that are below the dome 12 and that lie underneath the lower portion of the sheet 26.

With this invention, any water that leaks down past tiles 30 which are above the dome 12 will be directed by the sheet 26 around the curb 32 and down onto the tops of tiles 30 that are below the dome 12, thereby providing a water seal for the skylight 10.

While the particular TUBULAR SKYLIGHT WITH DOME FLASHING AND PROTECTIVE CORRUGATION as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for" or, in the case of a method claim, the element is recited as a "step" instead of an "act". Absent express definitions herein, claim terms are to be given all ordinary and accustomed meanings that are not irreconciliable with the present specification and file history.

What is claimed is:

1. A tubular skylight, comprising:

a transparent dome;

a flashing coupled to the dome to mount the dome on a roof, the flashing having an upwardly-projecting portion;

a skylight tube depending downwardly from the dome; and a sheet of corrugated metal mounted on the roof and coupled to the flashing, the sheet having a circular hole formed therein with corrugations entirely surrounding the hole, the hole defining a periphery closely spaced from the flashing, the sheet being conformable to roof tiles to provide a seal, wherein the sheet is formed with a curb circumscribing the hole, the curb being coupled with the upwardly-projecting portion of the flashing, the sheet and the curb being a single unitary piece of metal.

2. The skylight of claim 1, wherein the upwardly-projecting portion of the flashing defines an upper circular edge and the skylight further comprises plural bendable tabs extending radially inwardly from the curb of the sheet and being bendable over the edge to engage the sheet with the flashing without the need fit fasteners.

3. The skylight of claim 2, further comprising a flashing extension coupling the flashing to the dome.

4. The skylight of claim 3, wherein the flashing extension is engaged with the dome and flashing using fasteners.

5. The skylight of claim 1, wherein the sheet is made of a single piece of material including at least one of: Aluminum, Copper, Lead, malleable Zinc.

6. The skylight of claim 1, wherein the roof defines an incline and the sheet defines elongated corrugations extending generally parallel to the incline when the sheet is mounted on the roof.

7. A method for mounting a tubular skylight, comprising:

receiving a corrugated single piece sheet defining a hole and a curb rising above and circumscribing the hole, wherein the sheet has corrugations entirely surrounding the curb;

engaging the curb with a skylight flashing mounted on a roof having a slanted orientation defining a pitch with an upper portion of the sheet relative to the pitch of the roof being disposed underneath at least one roof tile above the flashing and with a lower portion of the sheet relative to the pitch of the roof being disposed on top of at least one roof tile that is located lower on the roof than is the flashing; and coupling a skylight cover with the flashing, the flashing extending through the corrugated sheet.

8. The method of claim 7, wherein the flashing defines an upper circular edge and the sheet includes plural bendable tabs extending radially inwardly from the curb of the sheet and being bendable over the edge to engage the sheet with the flashing without the need for fasteners.

9. The method of claim 7, further comprising engaging a flashing extension with the flashing and cover.

10. The method of claim 7, wherein the sheet is made of Aluminum.

11. The method of claim 7, wherein the roof defines an incline and the sheet defines elongated corrugations, and the method includes orienting the sheet with the corrugations generally parallel to the incline.

12. The method of claim 11, further comprising deforming the sheet to conform to at least one roof tile.

13. A lighting system comprising:

a transparent skylight cover;

a light diffuser;

a tubular structure extendable between the cover and diffuser; and a single corrugated sheet configured for circumscribing the tubular structure between the cover and the diffuser to impede water leakage through a roof above which the cover is to be disposed, wherein the sheet is formed with a curb, the curb being coupled to a flashing, wherein flashing defines an upper circular edge and the sheet further comprises plural bendable tabs extending radially inwardly from the curb of the sheet and being bendable over the upper circular edge to engage the sheet with the flashing without the need for fasteners.

14. The system of claim 13, wherein the flashing is couplable to the cover to mount the cover on a roof, at least one skylight tube being configured for depending downwardly from the cover.

15. The system of claim 14, wherein the sheet has a hole formed therein, the hole defining a periphery closely spaced from the flashing.

16. The system of claim 14, further comprising a flashing extension coupling the flashing to the cover.

17. The system of claim 13, wherein the sheet is made of a material selected from the group consisting of: Aluminum, Copper, Lead, malleable Zinc.

* * * * *